US007311266B2

(12) United States Patent
Santry

(10) Patent No.: US 7,311,266 B2
(45) Date of Patent: Dec. 25, 2007

(54) FREEZE-PROOF WATER VALVE FOR SUPPLYING SECONDARY WATER TO SNOW MAKING APPARATUS

(76) Inventor: Charles N. Santry, 16 Clyde St., Chestnut Hill, MA (US) 02167

( * ) Notice: Subject to any disclaimer, the term of this patent is extended or adjusted under 35 U.S.C. 154(b) by 0 days.

(21) Appl. No.: 10/589,330

(22) PCT Filed: Jan. 10, 2006

(86) PCT No.: PCT/US2006/001027

§ 371 (c)(1),
(2), (4) Date: Aug. 14, 2006

(87) PCT Pub. No.: WO2006/076458

PCT Pub. Date: Jul. 20, 2006

(65) Prior Publication Data

US 2007/0152079 A1 Jul. 5, 2007

Related U.S. Application Data

(60) Provisional application No. 60/643,661, filed on Jan. 13, 2005.

(51) Int. Cl.

| | |
|---|---|
| ***F25C 3/04*** | (2006.01) |
| ***F16K 49/00*** | (2006.01) |
| ***F16L 53/00*** | (2006.01) |
| ***B05B 7/16*** | (2006.01) |
| ***B05B 1/24*** | (2006.01) |
| ***B05B 1/30*** | (2006.01) |

(52) U.S. Cl. ..... 239/14.2; 239/110; 239/124; 239/443; 239/581.1; 239/128; 239/139; 137/339; 137/624.46

(58) Field of Classification Search ..... 239/14.2, 239/110, 124, 128, 139, 443, 581.1, 2.2, 106, 239/135, 444, 447, 582.1; 137/339, 625.46, 137/625.47, 625.48, 59–62
See application file for complete search history.

(56) References Cited

U.S. PATENT DOCUMENTS 4,717,072 A * 1/1988 Girardin ..... 239/75

(Continued)

*Primary Examiner*—Darren Gorman
(74) *Attorney, Agent, or Firm*—Carothers & Carothers

(57) ABSTRACT

A freeze-proof water valve (10) for supplying secondary water under pressure in freezing ambient conditions to a snow making apparatus (11) having primary water spray nozzles (12) and secondary water spray nozzles (13,14). The valve housing (15) is provided with an interior primary water chamber (16) with a water inlet (17) and a primary water outlet (18) for continuous passage of primary water under pressure therethrough for delivery to primary water spray nozzles (12) on the snow making apparatus (11). A valve body (22,24) is mounted within this valve housing (15) within the primary water chamber (16) for flow of water therearound from the housing inlet (17) to the primary outlet (18) to prevent freeze-up of the valve body (22,24) when in the off position. The valve body (22,24) is movable between an on position and an off position whereby water from the primary chamber (16) is directed to a secondary outlet (20,25) when the valve (22,24) is in the on position for feeding water to the secondary water spray nozzle or nozzles (13,14). Water in the primary chamber (16) is shut off from this secondary outlet (20,25) and water in this secondary outlet (20,25) is directed instead to a water drain outlet (21) for discharge when the valve (22,24) is in the off position.

3 Claims, 2 Drawing Sheets

U.S. PATENT DOCUMENTS 5,628,456 A * 5/1997 Dupre ..... 239/14.2
5,749,517 A * 5/1998 Dupre ..... 239/14.2
5,823,427 A * 10/1998 Dupre et al. ..... 239/14.2
6,032,872 A * 3/2000 Dupre ..... 239/14.2
6,168,089 B1 * 1/2001 Dupre ..... 239/14.2
6,374,848 B1 * 4/2002 McGhee ..... 137/62
6,508,412 B1 * 1/2003 Pergay et al. ..... 239/14.2
2003/0141377 A1 * 7/2003 Dupre ..... 239/2.2

* cited by examiner

FREEZE-PROOF WATER VALVE FOR SUPPLYING SECONDARY WATER TO SNOW MAKING APPARATUS

CROSS REFERENCE

This patent application claims the benefit of U.S. Provisional Patent Application No. 60/643,661, filed 13 Jan. 2005, for MULTI-VALVE FREEZE-PROOF DESIGN FOR SNOW MAKING.

BACKGROUND OF THE INVENTION

This invention relates generally to the art of valves and more particularly to water valves for supplying secondary water under pressure to a snow making apparatus in freezing ambient conditions.

Snow making apparatus of the type disclosed in U.S. Pat. No. 5,823,427 describes a snow making apparatus, in this instance a snow making tower, wherein air and water are supplied under pressure to the top of the tower and discharged under pressure through nozzles to form plumes of atomized water for producing snow in sub-freezing conditions. In actuality, the air supplied under pressure may be internally mixed within the primary water before it is discharged or alternatively the air under pressure may be discharged externally into the plumes of atomized water.

Additional water nozzles are positioned at the top of the tower to discharge more water in the form of spray. This additional supply of secondary water is independently valved for different ambient temperature conditions. The problem arises in freezing ambient conditions that this valve or valves supplying secondary water to the snow making apparatus freeze up in freezing ambient conditions when the valves are in an off position.

It is a primary object of the present invention to provide water valves for supplying additional water under pressure to the snow making apparatus which are freeze-proof.

BACKGROUND OF THE INVENTION

The freeze-proofwater valve or valves of the present invention are provided for supplying secondary water under pressure to a snow making apparatus having primary water spray nozzles and at least one secondary water spray nozzle in freezing ambient conditions. The water valve of the present invention is comprised of a valve housing having an interior primary water chamber with a water inlet and a primary water outlet for continuous passage of primary water under pressure therethrough for delivery to the primary water spray nozzles of the snow making apparatus. A first secondary water outlet is also provided in the valve housing for delivery of secondary water under pressure to the secondary water spray nozzles, and a water drain outlet is also provided in the valve housing.

A first valve body is mounted in the valve housing within the primary water chamber for continuous flow of water around the valve body from the housing inlet to the primary outlet of the housing to thereby prevent freezing of the valve body. The valve body is moveable between an on position and an off position whereby water from the primary chamber is directed to the first secondary outlet when the valve is in the on position, and water in the primary chamber is shut off from the this first secondary outlet, and water in the first secondary outlet is directed to the water drain outlet for discharge when the valve body is in the off position.

If more than one set of secondary water spray nozzles are provided in the snow making apparatus, a second valve body may be mounted in the valve housing within the same primary water chamber. This second valve body is moveable between an on and off position, in the same manner as is the first valve body, whereby water from the primary chamber is directed to a second secondary outlet in the valve housing for delivery of secondary water under pressure to one or more secondary water spray nozzles of the snow making apparatus when the second valve body is in the on position. Water in the primary chamber of the valve housing is shut off from this second secondary outlet and the water in the second secondary outlet is directed to a drain outlet in the housing for discharge when this second valve body is in the off position.

Accordingly, when the valve bodies are in the off position, all water is drained back from the snow making apparatus and discharged through the drain outlet or outlets of the valve housing so that no stationary water remains in the valve housing or snow making apparatus. Additionally the primary water continues to flow around and about and through the primary chamber around the valve bodies preventing freeze-up in the off condition. The valve bodies may be of any conventional type, such as ball valves, cylinder valves, push-pull valves, twist valves or gate valves. In addition, the freeze-proof water valve of the present invention may be used with either internal or external mixing type snow making apparatus, such as snow guns, ground sleds, guns mounted on poles or tower snow guns, as well as fan driver snow guns.

BRIEF DESCRIPTION OF THE DRAWINGS

Other objects and advantages appear hereinafter in the following description and claims. The accompanying drawings show, for the purpose of exemplification, without limiting the scope of the invention or appended claims, certain practical embodiments of the present inventions wherein:

DETAILED DESCRIPTION OF A PREFERRED EMBODIMENT

Figure 1:
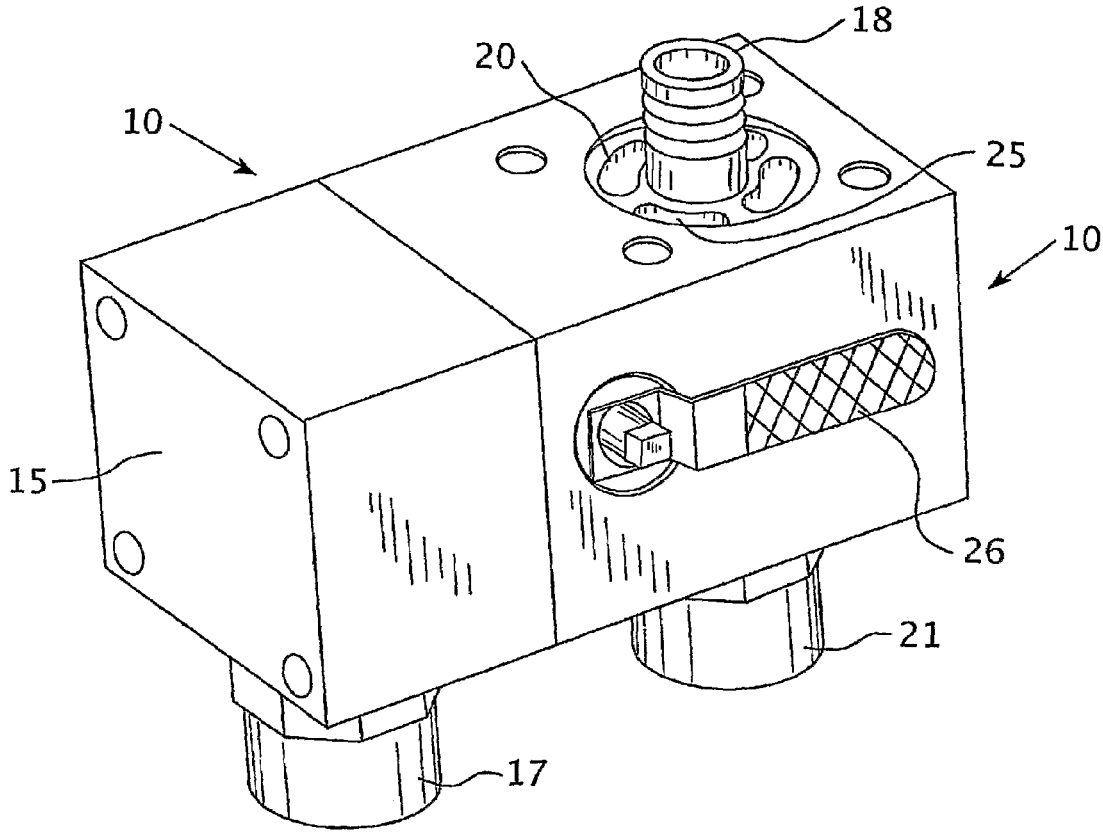
FIG. 1 is an isometric view of the freeze-proof water valve of the present invention.

Referring to the drawings, the freeze-proof water valve 10 is provided for supplying secondary water under pressure to snow making apparatus 11 having primary water spray nozzles 12 and first and second secondary water spray nozzles 13 and 14. This snow making apparatus 11 is of the same type illustrated in U.S. Pat. No. 5,823,427, and the description in this patent is incorporated herein by reference for the purposes of teaching the detailed operation of such a snow making apparatus. However, it must be remembered that the freeze-proof water valve of the present invention is applicable to any type of snow making apparatus which incorporates primary nozzle sprays and optionally operable secondary water sprays, no matter whether the snow making apparatus 11 be of the internal or external air mixing type or fan type.

The freeze-proof valve 10 of the present invention is comprised of a housing 15 having an interior primary water chamber 16 with a water inlet 17 and a primary water outlet 18 for continuous movement or passage of primary water under pressure therethrough for delivery to primary water spray nozzles 12. A first secondary water outlet 20 is provided in valve housing 15 for delivery of secondary water under pressure to at least one first secondary water spray nozzle 13. A water drain outlet 21 is also provided in the valve housing 15.

Figure 2:
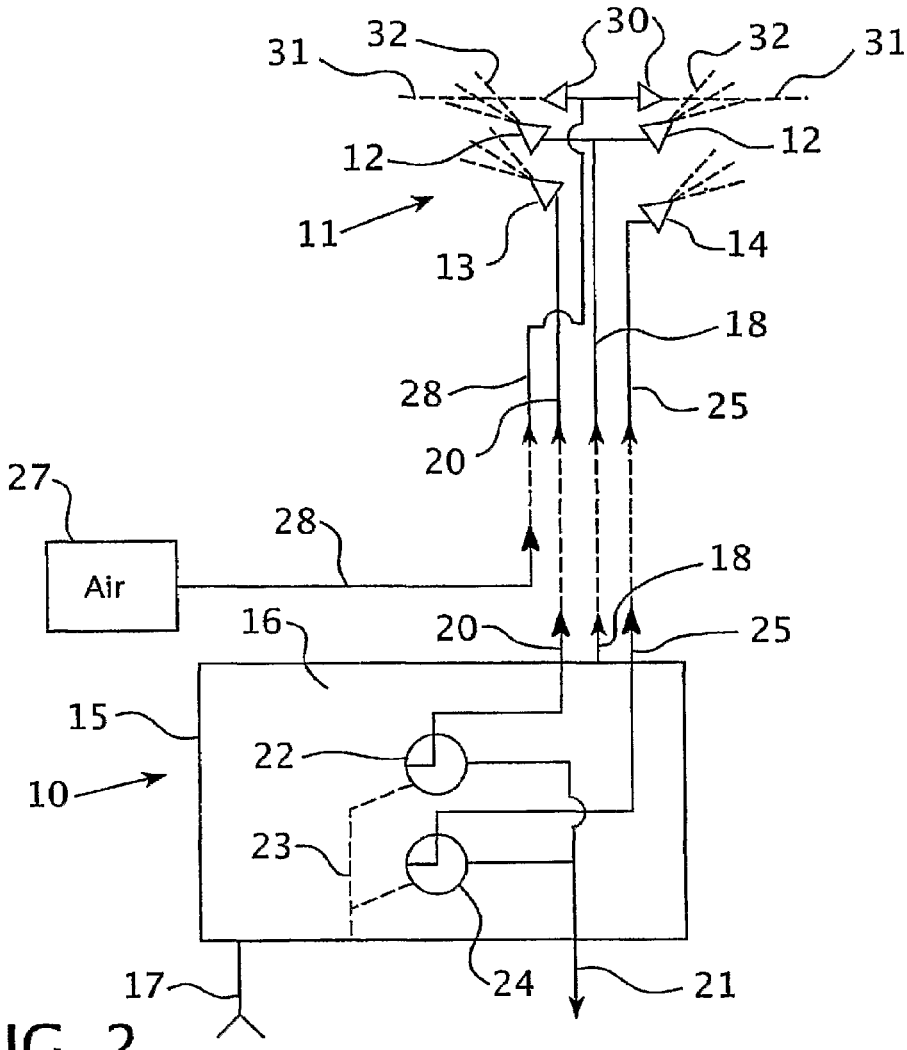
FIG. 2 is a schematic representation of the internal workings of the valve illustrated in FIG. 1 as connected to a snow making apparatus, with the valve bodies shown in their on position.

A first valve of body 22 is mechanically mounted in housing 15 as indicated schematically by the dashed mounting line 23, within primary water chamber 16 for flow of water therearound from housing inlet 17 to primary outlet 18 to thereby prevent freezing of the valve body 22. Valve body 22 is moveable between the on position as shown in FIG. 2, and an off position shown in FIG. 3, whereby water from the primary chamber 16 is directed to the first secondary outlet 20 when the valve body 22 is in the on position as shown in FIG. 2. Water in the primary chamber 16 is shut off from this first secondary outlet 20 and water in this first secondary outlet 20 is directed to the water drain outlet 21 for discharge when the valve body 22 is in the off position as illustrated in FIG. 3.

The valve 10 of the present invention as illustrated in the figures includes a second valve body 24 mounted in the housing 15 within primary water chamber 16 for supply of water under pressure to second secondary water spray nozzle 14. This valve body 24 may be eliminated if the snow making apparatus 11 is only provided with one secondary water spray nozzle 13 or one set of water spray nozzles 13.

Figure 3:
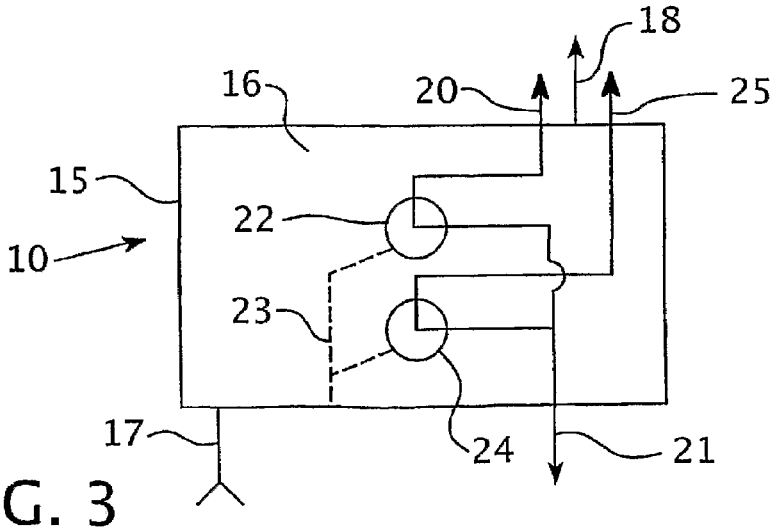
FIG. 3 is a schematic diagram of the freeze-proof water valve shown in FIG. 2 with the valve bodies shown in the off position.

This second valve body 24, in a manner similar to first valve body 22, is moveable between an on position shown in FIG. 2 and an off position shown in FIG. 3 whereby water from primary water chamber 16 is directed to second secondary outlet 25 in housing 15 for delivery of secondary water under pressure to one or more second secondary water spray nozzles or nozzle 14 of snow making apparatus 11 when the second valve body 24 is in the on position as shown in FIG. 2. Water in primary water chamber 16 is shut off from this second secondary outlet 25 and water in the second secondary outlet 25 is directed to drain outlet 21 in housing 15 for discharge when second valve body 24 is in the off position as shown in FIG. 3. This causes all of the remaining secondary water leading up to secondary water nozzles 13 and 14 to entirely drain out of the snow making apparatus 11 through outlets 20 and 25 to discharge through drain 21 to ambient. Thus no freeze-up can occur in the snow making apparatus or within the valve structure when it is in the off position as shown in FIG. 3 as water continues to continuously flow from inlet 17, through primary water chamber 16, which flows around and surrounds valve bodies 22 and 23, on out through primary outlet 18.

The valve bodies 22 and 24 are mechanically operated by means of valve handles 26 on either side of the valve housing 15 as shown in FIG. 1. However, it must be remembered that these valve bodies 22 and 24 may be independently automatically actuated by electronically operated or fluid operated actuators. Also, the valve housing 10 may be conveniently remotely located or secured directly to the snow making apparatus, such as by bolts or the like fasteners. Alternatively, the housing 15 may even be welded to the snow making apparatus.

The snow making apparatus 11 shown in FIG. 2 is shown as an external mixing type wherein air under pressure is supplied from air compressor 27 through air hose 28 to the top of snow making apparatus 11 wherein the air is discharged through nozzles 30 in the form of jet streams 31 into the primary water sprays 32 in order to form plumes of atomized water. However, as previously stated, it must be remembered that the present invention is applicable to either external or internal mixing type snow making apparatus, fan snow makers, and to snow making apparatus of all types which require the inclusion of secondary water sprays which are independently operated from a continuously operating primary water spray.

The pipe lines 18, 20, 25 and 28 for tower type snow making apparatus may be run side by side, coaxially or in a segmented pipe as desired.

I claim:

1. A freeze proof water valve for supplying secondary water under pressure to a snow making apparatus having primary water spray nozzles and at least one secondary water spray nozzle in freezing ambient conditions, comprising:

a valve housing having an interior primary water chamber with a water inlet and a primary water outlet for passage of primary water under pressure therethrough for delivery to said primary water spray nozzles;

a first secondary water outlet in said valve housing for delivery of secondary water under pressure to said at least one first secondary water spray nozzle, and a water drain outlet in said valve housing;

a first valve body mounted in said housing within said primary water chamber for flow of water therearound from said housing inlet to said primary outlet to prevent freezing of said valve body, said valve body moveable between an on position and an off position whereby water from said primary chamber is directed to said first secondary outlet in said on position, and water in said primary chamber is shut off from said first secondary outlet and water in said first secondary outlet is directed to said water drain outlet for discharge when in said off position.

2. The freeze proof water valve of claim 1, including a second valve body mounted in said housing within said primary water chamber, said second valve body moveable between an on position and an off position whereby water from said primary chamber is directed to a second secondary outlet in said housing for delivery of secondary water under pressure to a second at least one secondary water spray nozzle of said snow making apparatus when said second valve body is in said on position, and water in said primary chamber is shut off from said second secondary outlet and water in said second secondary outlet is directed to a drain outlet in said housing for discharge when said second valve body is in said off position.

3. The freeze proof water valve of claim 1, wherein said first valve body is a lever operated ball valve.

* * * * *